US005500996A

United States Patent [19]

Fritsch et al.

[11] Patent Number: 5,500,996

[45] Date of Patent: Mar. 26, 1996

[54] METHOD FOR MANUFACTURING A THERMISTOR HAVING A NEGATIVE TEMPERATURE COEFFICIENT IN MULTI-LAYER TECHNOLOGY

[75] Inventors: Georg Fritsch; Hans G. Schuster, both of Graz, Austria

[73] Assignee: Siemens Aktiengesellschaft, Munich, Germany

[21] Appl. No.: 20,435

[22] Filed: Feb. 22, 1993

Related U.S. Application Data

[62] Division of Ser. No. 757,604, Sep. 11, 1991, abandoned.

[30] Foreign Application Priority Data

Sep. 21, 1990 [DE] Germany ..... 40 29 988.0

[51] Int. Cl.[6] ..... H01C 7/04

[52] U.S. Cl. ..... 29/612; 338/22 R; 264/61

[58] Field of Search ..... 29/612; 264/61, 264/62; 338/22 R, 22 SD, 204, 205, 307; 361/321

[56] References Cited

U.S. PATENT DOCUMENTS

| | | | |
|---|---|---|---|
| 2,886,476 | 5/1959 | Dumesnil et al. | 338/308 X |
| 4,189,760 | 2/1980 | Marshall | 361/321 |
| 4,454,495 | 6/1984 | Werner et al. | 338/314 X |
| 4,766,409 | 8/1988 | Mandai | 338/22 R |
| 4,918,421 | 4/1990 | Lawless et al. | 29/612 |

FOREIGN PATENT DOCUMENTS

| | | | |
|---|---|---|---|
| 0189087 | 1/1986 | European Pat. Off. | H01C 7/10 |
| 2321478 | 11/1973 | Germany | H01C 7/04 |
| 3725455 | 2/1989 | Germany | B32B 18/00 |
| 1337929 | 11/1973 | United Kingdom | H01L 5/00 |

*Primary Examiner*—P. W. Echols
*Attorney, Agent, or Firm*—Hill, Steadman & Simpson

[57] ABSTRACT

In a method for manufacturing a thermistor having a negative temperature coefficient in multi-layer technology, a plurality of layers are produced of ceramic material by producing a suspension and then drawing out with a stripping technique to form an extremely thin film from which the individual ceramic material layers are formed. By a silk screening technique, metal coats are applied onto the ceramic metal layers, the metal coats containing at least one precious metal as a critical constituent selected from the group consisting of Hg, Au, Pd, and Pt. The metal layers extend from one side edge of the ceramic layer over the ceramic layer and stop short of and are spaced from the opposite side edge. The ceramic layers are stacked on top of one another, but with an alternating offset of the metal coats. A solderable metallization is applied at sides of the stack and is connected to every other coat at the respective sides.

6 Claims, 1 Drawing Sheet

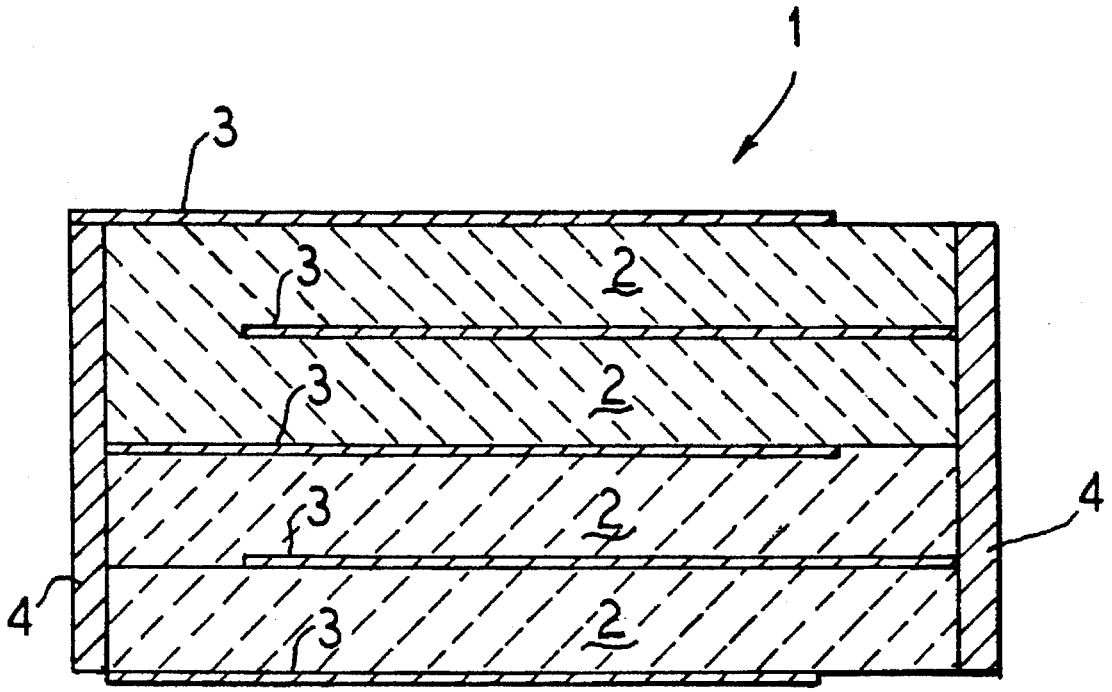
1
3
3
2
3
2
3
2
4
4
3
2

METHOD FOR MANUFACTURING A THERMISTOR HAVING A NEGATIVE TEMPERATURE COEFFICIENT IN MULTI-LAYER TECHNOLOGY

This is a division of application Ser. No. 757,604, filed Sep. 11, 1991, now abandoned.

The invention is directed to a thermistor having a negative temperature coefficient in multi-layer technology.

BACKGROUND OF THE INVENTION

There has been a need for some years to transfer multilayer (ML) technology, which has proven itself and has been known for a long time in the manufacture of ceramic multilayer capacitors, to other ceramic components as well. The transfer of a first modification of the ML technology onto varistors is known, for example, from European Patent 0 189 087, incorporated herein. The varistor is thereby constructed of thin layers of varistor material having precious metal electrodes lying therebetween, these being respectively conducted out at an end side and being connected to one another with a metallization (solder area). The precious metal electrodes that have a relatively high melting point are applied onto the thin ceramic layers with silk screening and before the sintering process in this modification of the ML technology.

The transfer of ML technology onto temperature-dependent thermistors has hitherto been disclosed, not for thermistors having a negative temperature coefficient (NTC, high-temperature conductors), but only for PTC elements (posistors) and only within the framework of a second modification of the known ML technology (U.S. Pat. No. 4,766,409, incorporated herein). In this modification, the ceramic member is alternately constructed of porous and dense ceramic layers, whereby metal alloys whose melting temperatures are considerably lower than the sintering temperature of the ceramic member are pressed into the cavities of the porous intermediate layers. The internal electrodes are thus produced after the sintering process by being pressed in and by subsequent solidification of the molten metal, whereby the penetration of the molten metal, the moistening of the ceramic material, and preventing the molten metal from flowing out again, raise a number of problems that, for example, are described in German Published Application 37 25 455, incorporated herein.

U.S. Pat. No. 4,766,409 initially proceeds on the basis that ML technology is especially suitable for the realization of a PTC thermistor having a resistance of only about 0.3 through 3 ohms on the basis of the parallel connection of many thin ceramic layers within a single component. Attempts to manufacture such a PTC thermistor are disclosed in the Letters Patent, a refractory metal paste being applied onto the ceramic layers before the sintering by analogy to the most widespread ML ceramic capacitors. The metals having a high melting point that come into consideration (gold, platinum, palladium, silver-palladium alloy), however, did not lead to functioning internal electrodes since, according to the Letters Patent, barrier layers arose. It has in fact been known for a long time that complications involving non-conductive barrier layers at the ceramic surface metallized with precious metals can arise in PTC resistors, but not in NTC thermistors.

Due to the test results, the U.S. patent states that these refractory metals are unsuitable for internal electrodes of PTC resistors. The U.S. Letters Patent subsequently points out that electrodes free of barrier layers which are composed of an indium-gallium alloy as well as of nickel or aluminum are known, but, as its own solution, proposes that internal electrodes of lead, tin, or of an alloy of these two metals, be pressed into porous intermediate layers of ceramic after the sintering. Such internal electrodes are in fact free of barrier layers. The metals employed, however, have poor moistening properties, for which reason additional protective measures to prevent the injected, molten metals from flowing out must be undertaken, these making the known PTC resistor even more complicated.

SUMMARY OF THE INVENTION

An object of the present invention is to specify a method for making a thermistor which has a negative temperature coefficient in multi-layer technology that, on the one hand, guarantees a good bonding, i.e. a connection having low electrical contact resistance between the internal electrodes and the ceramic surface, and that, on the other hand, is simply constructed and can be manufactured in a simplified way.

For achieving this object, the method of the invention comprises the following steps:

- producing a plurality of layers formed of fine-particle ceramic material by first producing a suspension with an initial material and organic bonding materials, solvents, and softening agents and then subsequently drawing out with a stripping technique to form an extremely thin film from which the individual fine-particle ceramic material layers are formed;
- applying metal coats by a silk screening technique onto the fine-particles ceramic layers, the metal coats containing at least one precious metal as a critical constituent and selected from the group consisting of Ag, Au, Pd, Pt, said metal coats extending from one side edge of each ceramic layer over the ceramic layer but stopping short of and being spaced from the opposite edge;
- stacking the ceramic layers with the respective coats on top of one another but with an alternating offset of the metal coats; and
- pressing the stack, sintering the stack, and applying a solderable metallization at sides of the stack to connect to every other coat at the respective sides.

BRIEF DESCRIPTION OF THE DRAWING

The drawing FIGURE illustrates a thermistor according to the invention having a negative temperature coefficient in multi-layer technology.

DESCRIPTION OF THE PREFERRED EMBODIMENTS

The wired or unwired NTC thermistor chips of the invention can be mechanically loaded, have small dimensions (for example, 3.2×1.6 mm given a thickness of 1.3 mm), and having electrical resistances from 0.1 ohm through 1 mega ohm (at 25° C.). At the very most, values of resistance just below 500 ohms can be realized with the conventional dry-pressing technology wherein a granulate is pressed to form a thermistor blank without layer structure, since the ceramic members would otherwise become too thin and too mechanically sensitive. The pressing technology, moreover, is complicated and expensive. Due to the parallel connection realized on the basis of the specific ML structure—and that goes beyond the structure of ceramic layers without internal electrodes arranged above one another that is also possible and especially suitable for the high-impedance range above approximately 3 k ohm—the NTC thermistors of the invention have the general advantage that their resistance can be set largely independently of their external dimensions.

It has been shown that functional NTC thermistors having an arbitrary number of internal electrodes composed of combinations or mixtures of alloys of the metals Ag, Al, Au, Co, Cr, Cu, Fe, In, Ir, Mo, Ni, Pb, Pd, Pt, Sn, Ta, Ti, V, W, Zn, Zr can be produced, whereby the specific NTC ceramic composition is not critical. With the present inventin, the metal coats applied by printing (silk screening) contain at least one precious metal, particularly an element from the group Ag, Au, Pd, Pt as a critical consituent.

Internal electrodes whose critical constituents are palladium and silver have often proven themselves in ML technology. There is thus an interest to select a silver proportion above 50% by weight for reasons of cost, due to the better elimination of heat arising in the inside of the monolithic block and in order to avoid migration. Internal electrodes composed in this way and applied before the sintering, however, would melt at the sintering temperatures of approximately 1200° C. which are usually necessary. The sintering reactivity of the ceramic material, however, is enhanced due to the selection of an especially fine-particle initial ceramic material such that a lower sintering temperature in the range of about 950° through 1150° C. is enabled. Such a fine-particle initial material, for example, can be acquired by mechanical powder preparation methods, for instance liquid doping, that are increasing in significance.

The manufacture of an NTC thermistor of the invention occurs in that a slip or suspension is produced in a known way from the initial material with the assistance of organic bonding materials, solvents, and softening agents as well. This slip or suspension is subsequently drawn out with a stripping technique to form an extremely thin film. A pattern composed of the approximately 2–3 μm thick internal metal coats, and composed of a silver-palladium compound having a silver part of 70 to 80% by weight, is applied with a known silk screening technique onto portions of the film produced in this way that have the approximate size of a postcard card. Thus, a corresponding number of such postcard-size films are stacked on top of one another such that the alternating offset of the metal coats results in the finished member. After a pressing process, finally the layer thermistor is separated in rough form from the film stack and is sintered at temperatures up to 1150° C. after undergoing the standard cycle of tempering and expelling the binder. Compared to known ML thermistors manufactured by impressing lead, with porous intermediate layers and special metallizations, the NTC thermistors manufactured in this way are less complicated.

The resulting thermistor of the invention is shown in the drawing FIGURE generally at 1 in the form of a cuboid monolithic member. Ceramic layers 2 are shown with the internal electrode metal coats 3 applied thereto. A solderable metallization 4 is provided at sides connecting to every other internal electrode.

The sintered NTC thermistors can subsequently be provided with a solderable metallization by immersion, printing, sputtering, vacuum metallization, or on the basis of electro-deposition, this solderable metallization also being potentially composed of the aforementioned metals. Finally, an optional enveloping of the surface of the thermistors with lacquers, epoxy resins or fluxes can also be implemented.

Although various minor changes and modifications might be proposed by those skilled in the art, it will be understood that we wish to include within the claims of the patent warranted hereon all such changes and modifications as reasonably come within our contribution to the art.

We claim as our invention:

1. A method for manufacturing a multi-layer thermistor having a negative temperature coefficient, comprising the steps of:

producing a plurality of layers formed of fine-particle ceramic material by first producing a suspension with an initial material and organic bonding materials, solvents, and softening agents and then subsequently drawing out with a stripping technique to form an extremely thin film from which the individual fine-particle ceramic material layers are formed;

applying metal coats by a silk screening technique onto the fine-particle ceramic material layers, the metal coats containing at least one precious metal as a critical constituent and selected from the group consisting of Ag, Au, Pd, Pt, said metal coats extending from one side edge of each ceramic layer over the ceramic layer but stopping short of and being spaced from the opposite side edge;

stacking the ceramic layers with the respective coats on top of one another but with an alternating offset of the metal coats; and pressing the stack, sintering the stack, and applying a solderable metallization at sides of the stack to connect to every other coat at the respective sides.

2. A method according to claim 1 wherein the metal coats contain at least one element selected from the group Al, Pb as a further critical constituent.

3. A method according to claim 1 wherein the metal coats contain Pd and Ag as a critical constituent with a silver part of more than 50% by weight.

4. A method according to claim 3 wherein the silver part is between 70% and 80% by weight.

5. A method according to claim 3 wherein the metal coats are approximately in a range of 2 to 3 μm thick.

6. A method for manufacturing a multi-layer thermistor having a negative temperature coefficient, comprising the steps of:

producing a plurality of layers formed of fine-particle ceramic material by first producing a suspension with an initial material and organic bonding materials, solvents, and softening agents, and then subsequently drawing out with a stripping technique to form an extremely thin film from which the individual fine-particle ceramic material layers are formed;

applying metal coats by a silk screening technique onto the fine-particle ceramic material layers, the metal coats of 2–μm thickness containing at least one precious metal as a critical constituent and selected from the group consisting of Ag, Au, Pd, Pt, said metal coats extending from one side edge of each ceramic layer over the ceramic layer but stopping short of and being spaced from the opposite side edge;

stacking the ceramic layers with the respective coats on top of one another but with an alternating offset of the metal coats; and pressing the stack, tempering and expelling binder, sintering the stack, and applying a solderable metallization at sides of the stack to connect to every other coat at the respective sides.

* * * * *